US008035942B2

(12) United States Patent
Meinherz

(10) Patent No.: US 8,035,942 B2
(45) Date of Patent: Oct. 11, 2011

(54) SAFETY SWITCH DEVICE

(75) Inventor: Carl Meinherz, Malans (CH)

(73) Assignee: Cedes AG, Landquart (CH)

( * ) Notice: Subject to any disclaimer, the term of this patent is extended or adjusted under 35 U.S.C. 154(b) by 105 days.

(21) Appl. No.: 12/436,865

(22) Filed: May 7, 2009

(65) Prior Publication Data

US 2009/0251835 A1 Oct. 8, 2009

Related U.S. Application Data

(63) Continuation of application No. PCT/EP2007/009762, filed on Nov. 12, 2007.

(30) Foreign Application Priority Data

Nov. 10, 2006 (DE) ..... 10 2006 053 397

(51) Int. Cl.
*H02H 3/20* (2006.01)
*H02H 9/04* (2006.01)
*H01H 9/54* (2006.01)
*H01H 33/59* (2006.01)

(52) U.S. Cl. ..... 361/91.1; 361/166; 307/140; 307/141.8

(58) Field of Classification Search ..... 361/91.1, 361/166, 169.1; 307/140, 141.8
See application file for complete search history.

(56) References Cited

U.S. PATENT DOCUMENTS

| | | | | |
|---|---|---|---|---|
| 3,571,800 | A * | 3/1971 | Taylor et al. | 307/413 |
| 4,028,498 | A * | 6/1977 | Mehaffey et al. | 379/252 |
| 4,045,714 | A * | 8/1977 | MacLeod | 361/156 |
| 4,791,519 | A * | 12/1988 | Madsen | 361/42 |
| 4,916,628 | A * | 4/1990 | Kugler | 700/286 |
| 5,065,104 | A * | 11/1991 | Kusko et al. | 324/508 |
| 5,612,994 | A * | 3/1997 | Chen | 379/167.12 |
| 7,107,957 | B2 | 9/2006 | Denz et al. | |
| 7,446,437 | B2 * | 11/2008 | Paik et al. | 307/115 |
| 2006/0212745 | A1 | 9/2006 | Zansky et al. | |

FOREIGN PATENT DOCUMENTS

| | | |
|---|---|---|
| DE | 27 29 480 A1 | 1/1979 |
| DE | 36 42 233 A1 | 6/1988 |
| DE | 39 09 613 A1 | 9/1990 |
| EP | 0 681 310 B1 | 6/2000 |
| EP | 1 202 313 A1 | 5/2002 |
| GB | 2 203 907 A1 | 10/1988 |

* cited by examiner

*Primary Examiner* — Rexford Barnie
*Assistant Examiner* — Zeev Kitov
(74) *Attorney, Agent, or Firm* — Burr & Brown

(57) ABSTRACT

A safety switch device for switching a power supply for a load on and off, having at least one driveable switching element, in particular a relay, and a safety circuit for checking a switching state of the switching element. The switching element is in the form of a changeover switch in such a manner that a first contact is electrically connected to either a second contact or a third contact by means of a switching operation. A method for operating a safety switch device is also provided.

17 Claims, 4 Drawing Sheets

SAFETY SWITCH DEVICE

CROSS REFERENCE TO RELATED APPLICATION

This application is a continuation of International Application No. PCT/EP2007/009762 filed Nov. 12, 2007, and claims the benefit under 35 U.S.C. §119(a)-(d) of German Application No. 10 2006 053 397.6 filed Nov. 10, 2006, the entireties of which are incorporated herein by reference.

FIELD OF THE INVENTION

The invention relates to a safety switch device and to a method for operating a safety switch device.

BACKGROUND OF THE INVENTION

It is known practice to use positively driven contacts for safety-relevant electromechanical switching operations, for example with relays.

Such relays usually comprise a plurality of contacts. At least one contact is mechanically connected to all other contacts in order to be able to monitor the other contacts. The monitoring contact is usually "normally closed" and the make contacts are usually "normally open". "Normally open" or "normally closed" means that this switching position is assumed in the de-energized state, that is to say there is an open or closed position. The monitoring contact therefore always has the opposite switching position to the make contacts.

A monitoring contact makes it possible to determine whether the relay for the operating circuit is operating correctly. If the make contacts are open, the monitoring contact must be closed. Certified relays, in which it is guaranteed that the make contacts are open when the monitoring contact is closed and vice versa, are regularly used. This makes it possible to achieve a required safety level, for example 4.

The prior art also discloses solutions for monitoring relay contacts without a positively driven monitoring contact. DE 27 29 480 A1 discloses a method for monitoring and/or extending switchgear assemblies with contacts which are connected in series in operating circuits or electric circuits, for example for processing systems. In this prior art approach, the respective switching state of the contact is detected without any reaction using a monitoring circuit which is connected in parallel. A contactor is actuated depending on the switching state. A relay is provided in order to interrupt the circuit so that signals from the monitoring circuit do not adversely affect the contactor. However, the manner in which it can be ensured that the relay which decouples the power supply operates correctly remains open in this arrangement.

Another proposed solution is described in the European patent specification EP 0 681 310 B1. A monitoring circuit is provided in parallel with two relays which are connected in series. A filter circuit decouples the monitoring circuit.

SUMMARY OF THE INVENTION

The invention is based on the object of providing an improved option for being able to reliably monitor relays without a positively driven "monitoring contact".

The invention is first of all based on a safety switch device for switching a power supply for a load on and off, which device comprises at least one driveable switching element, in particular a relay, and a safety circuit for checking a switching state of the switching element. An important aspect of the invention is that the switching element is in the form of a changeover switch in such a manner that a first contact can be electrically connected to either a second contact or a third contact by means of a switching operation of the changeover switch. This procedure makes it possible to implement a load circuit and a safety circuit as separately operating circuits using a single relay, for example. This is because a "changeover switch" can be used to ensure that either the safety circuit or the load circuit is closed. If it is detected that the safety circuit is closed, the load circuit must be open.

In one embodiment of the invention, two driveable switching elements which are connected in series are provided. The respective first contacts in the series circuit are preferably connected to one another. The safety circuit is closed only when both series-connected switching elements have assumed a predefined switching state. This measure makes it possible to achieve a required safety level. In addition, the safety circuit can be completely decoupled from the load circuit by means of at least two changeover switches which are connected in series. This is because both poles of a load circuit can be opened, whereas two poles of a safety circuit can be closed and vice versa, using the changeover switch, with the result being that both circuits can be operated completely independently of one another.

The respective second contact is preferably electrically connected to the safety circuit and the respective third contact is preferably electrically connected to the load. In this case, "normally closed" contacts may be assigned to the safety circuit and the "normally open" contacts may be assigned to the load, for example, for the driveable switching elements which are connected in series.

A safety circuit is advantageously closed when the first and second contacts are electrically connected and a load circuit is advantageously closed when the first and third contacts are connected.

In another embodiment, the safety circuit comprises a transmission part and an evaluation part. The transmission part is arranged on one contact side of the at least one switching element and the evaluation part is arranged on the other contact side of the at least one switching element. If the at least one switching element is de-energized and the safety circuit is connected to the "normally closed" contacts, a signal transmitted by the transmission part can be detected by the evaluation part in the de-energized state. In this case, the "load contact" is open. If the signal is not received by the evaluation part, the switching element, for example a changeover relay, is defective. A suitable measure is then preferably initiated. The check is carried out in a corresponding manner in the case of two switching elements which are connected in series.

In another embodiment, electrical decoupling means are provided in order to decouple the safety circuit from the power supply for the load if the power supply is connected to the safety circuit. This may be implemented, for example, using capacitances, thus making it possible to achieve a high-pass filter action, which filters out DC components, for example if Y1 or Y2 capacitors are used. A transducer, for example an optocoupler or a transformer, is likewise conceivable.

Complete potential isolation can be achieved using an optocoupler or a transformer.

It is preferred that the safety circuit comprises overvoltage protection. This is particularly preferred when the safety circuit is not DC-decoupled from the load circuit. Both a transmission part of the safety circuit and an evaluation part preferably have corresponding decoupling means or such overvoltage protection. A coil, a diode, for example a zener diode, or a varistor may be used, for example, as overvoltage protection.

Another embodiment provides a control circuit which is designed to check whether two series-connected switching elements in the de-energized state are in a switching position in which the switching elements close the safety circuit. In this arrangement the "normally closed" contacts are connected to the safety circuit. An operation of changing over to the other state is preferably carried out only when the safety circuit detects a closed safety circuit by virtue of two closed switching elements. Otherwise, an error signal is preferably output and/or a suitable countermeasure initiated.

In another embodiment of the invention, at least two series circuits comprising at least two driveable switching elements are provided. A series circuit is preferably understood as meaning a series connection of switching contacts. A load, for example, can be switched using the respective series circuit.

In addition, it is preferred that the safety circuit is formed via each series circuit of a plurality of series circuits. Each series circuit can thus be checked. In particular, each series circuit is part of a separate safety circuit.

A load circuit is preferably formed via each series circuit.

In order to limit the complexity of the safety circuit, it is possible that two series circuits each comprising two driveable switching elements form part of a single safety circuit.

It is also possible to save on components by two parallel-connected series circuits comprising at least two driveable switching elements jointly using a detection device in order to form a safety circuit. In this context, it is preferred if currents of different intensities are driven via the parallel series circuits, as a result of which the detection device must detect a predefined current during normal operation if there is no error. If a deviation of a predefined current intensity results, it may be concluded that a short circuit has occurred, for example, in a branch or else between the branches. The different current intensities enable an assignment with regard to the branch of the parallel-connected series circuits in which a problem has occurred.

In the case of a plurality of series circuits, it is advantageous if each driveable switching element comprises an actuator. This makes it possible to achieve a high degree of freedom with regard to possible circuit variants.

However, it is also conceivable for an actuator to actuate, for example, two driveable switching elements depending on a circuit task in the case of a plurality of series circuits.

For example, when a first and a second circuit comprising at least two driveable switching elements are connected in parallel, an actuator simultaneously actuates a respective driveable switching element in the first and second series circuits.

BRIEF DESCRIPTION OF THE DRAWINGS

A plurality of exemplary embodiments of the invention are explained in more detail below using the accompanying figures.

DETAILED DESCRIPTION OF THE INVENTION

Figure 1:
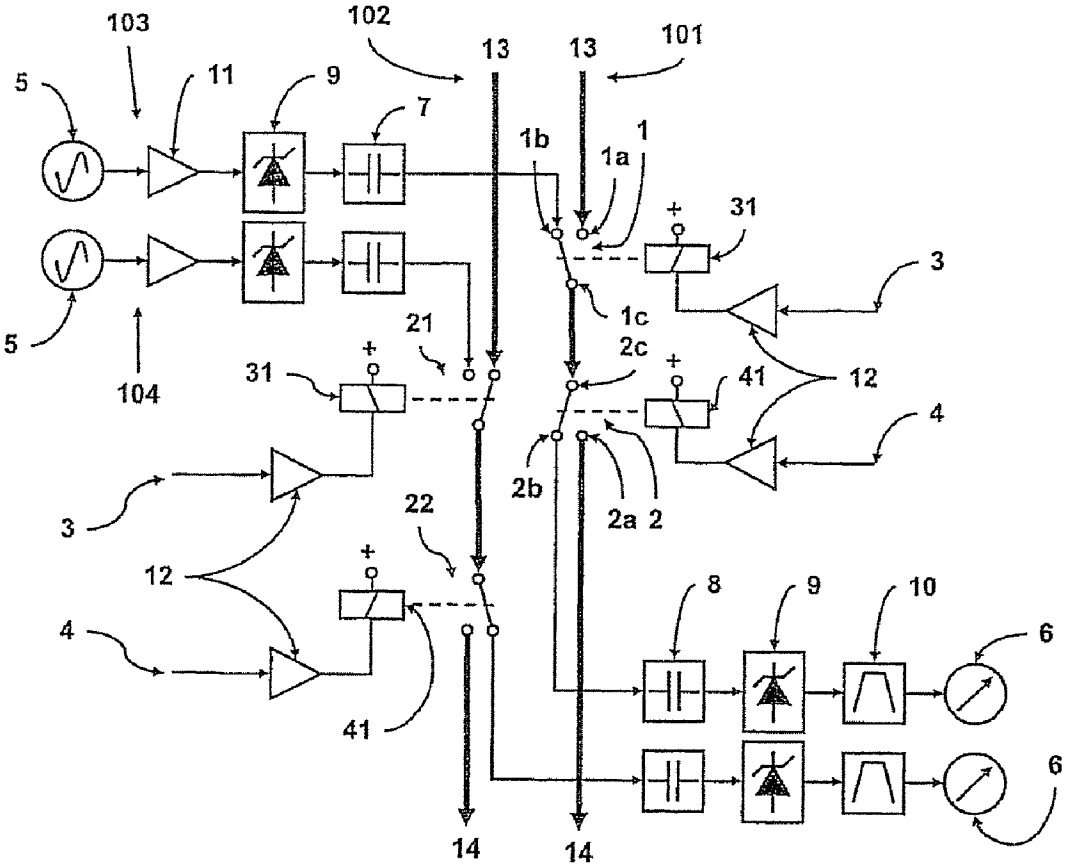
FIGS. 1-4 show schematic block diagrams of different safety switch devices with standard relays.

FIG. 1 illustrates a safety switch device having two load circuits 101, 102 and two safety circuits 103, 104.

The important factor is first of all that relays 1, 2 and 21, 22, respectively, are in the form of "changeover switches". In order to achieve a known safety level 4, it is necessary to connect two relays 1, 2 in series. Monitoring is effected by a signal from the signal source 5 (for example a pulse or another signal) being coupled in the "normally closed" state of the contacts 1*b*, 2*b* before the changeover relays 1, 2 close the make contacts 1*a*, 2*a*.

FIG. 1 illustrates relays 21, 22 of the second relay arrangement for the second load circuit 102 in another connection state.

The safety switch device 103 is first of all intended to be used to pursue the primary aim of checking whether all make contacts 1*a*, 2*a* are open before a corresponding control signal for closing the contacts is applied via the inputs 3, 4. Before the make contacts 1*a*, 2*a* are closed, the signal from the signal source 5 is transmitted to a detection device 6. If one of the contacts 1*a*, 2*a* is closed or both contacts are closed, no signal will reach the detection device 6. If, however, a signal is received by the detection device 6, it is certain that the make contacts 1*a*, 2*a* of both relays 1, 2 are still open and are thus operating properly. The relays can now be closed safely. A connection 13, 14 is thus closed in order to supply power to a load, for example. During normal operation, a load circuit 101, 102 is thus completely separated from the safety circuit 103, 104.

However, the situation in which the relays 1, 2 are switched at exactly the same moment will not actually be achieved. On account of different signal paths and different reaction times of the relays, a brief connection will occur between the first load circuit 101 and the first safety circuit 103 or between the second load circuit 102 and the second safety circuit 104.

High-pass filters, capacitors 7, 8 in the present case, are provided in order to protect the safety circuits 103, 104. Overvoltage protection 9 is also provided in the safety circuits 103, 104. This overvoltage protection may be implemented, for example, using a zener diode or a varistor. The transmission part of the safety circuits 103, 104 has a driver 11. The detection part of the safety circuits 103, 104 is provided with a bandpass filter 10 in order to be able to filter the corresponding signal from the signal source 5 for the detection device 6. Coils 31 and 41 of the relays 1, 2, 21, 22 are each connected to a coil driver 12.

The capacitances 7, 8 not only ensure that the safety circuits 103, 104 are decoupled in the case of temporal switching differences of the relays 1, 2, 21, 22, but if a relay 1, 2, 21, 22 fails and causes a short circuit, the capacitors 7, 8 likewise ensure that a power supply is decoupled from the monitoring electronics.

The described arrangement has the advantage that the load circuit 101, 102 is completely separated from the safety circuit 103, 104 during normal operation. This is achieved by means of the changeover switches 1, 2, 21, 22. It can be ensured that a test signal from the signal source 5 is never applied to the load circuit 101, 102. This can be effected by applying the test signal from the signal source 5 only when the switching operation has been safely carried out after a known switching time of the relays 1, 2, 21, 22.

The procedure according to the invention makes it possible to use conventional "SMD" relays which are smaller and more cost-effective than positively driven relays with a monitoring contact which are tested by the German technical inspectorate and are otherwise required.

An order of a switching time of the relays is effected, in particular, with regard to evaluation, for example by a microcontroller. The controller can then check whether the signals from a safety circuit are set as predefined.

Figure 2:
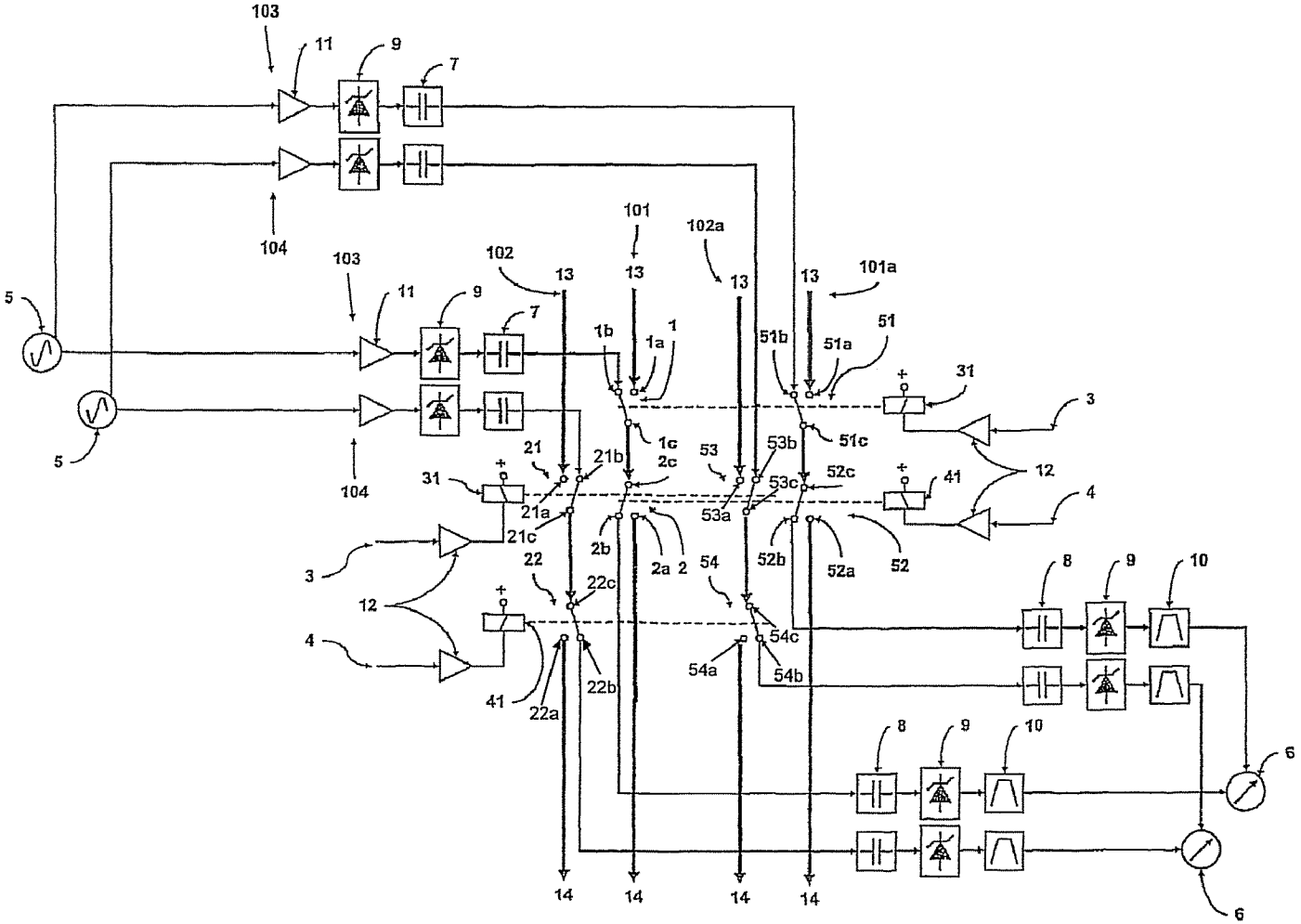
Figure 3:
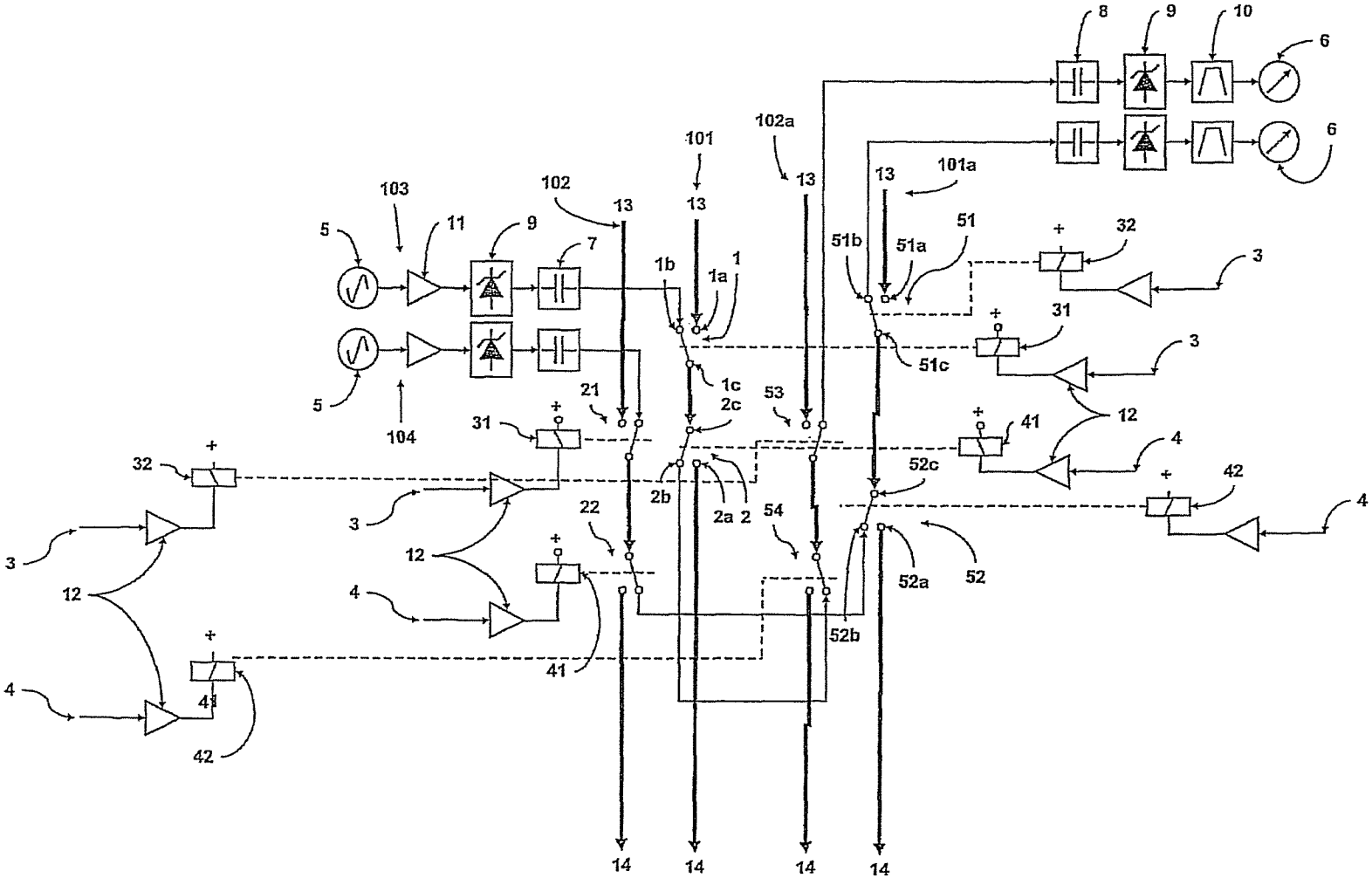
Figure 4:
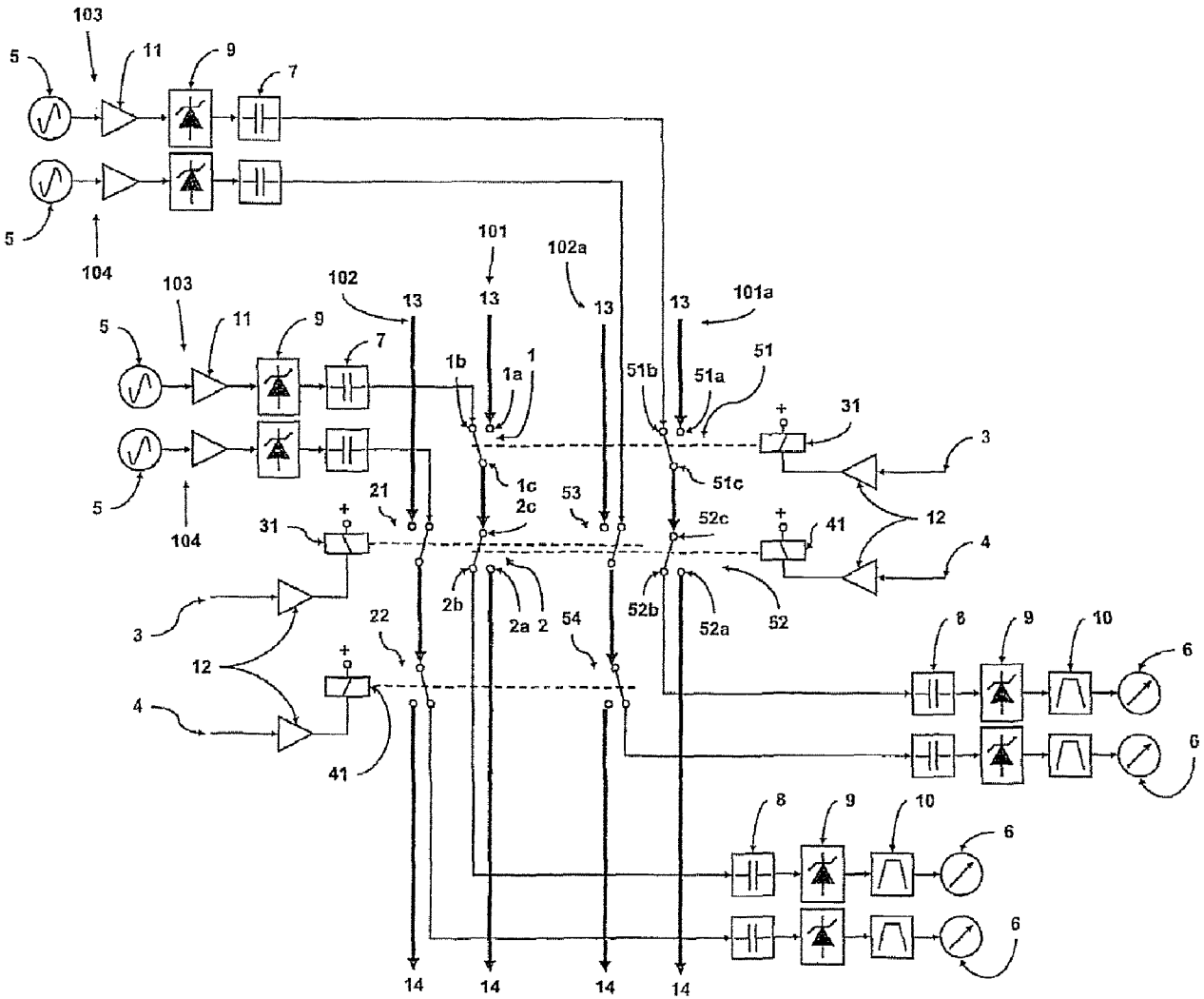

FIGS. 2-4 depict connection variants of series circuits comprising relays.

For example, in FIG. 2, each relay comprises a make contact 1*a* or 2*a* in a load circuit 101, make contact 51*a* or 52*a* in load circuit 101*a*, make contact 21*a* or 22*a* in load circuit 102 or make contact 53*a* or 54*a* in load circuit 102*a*. In contrast, the contacts 1*b* and 2*b*, and 51*b* and 52*b* are connection contacts for the safety circuit 103, and contacts 21*b* and 22*b* and 53*b* and 54*b*, respectively, are connection contacts for safety circuit 104. The contacts 1*c* and 2*c*, 51*c* and 52*c*, 21*c* and 22*c*, and 53*c* and 54*c* are respectively always connected to one another independent if they are part of the load or the safety circuit.

In the variant according to FIG. 2, two parallel circuits of series circuits each comprising two groups of relay contacts are formed. The circuit comprises four relays since two groups of relay contacts belong to one relay.

The four relays are driven by four coils 31, 41. Two groups of relay contacts are thus respectively connected to a common coil 31, 41. The groups of relay contacts 1, 51; 2, 52; 21, 53; 22, 54 are driven jointly. Each series circuit comprising two relays is electrically connected to a monitoring circuit comprising the driver 11 and the filter 10 as well as the protective elements 7 and 8 and overvoltage protection 9.

A special feature of the monitoring circuits 103 and 104 in FIG. 2 is that two monitoring branches respectively jointly use the signal source 5 and the detection device 6. This makes it possible to save on components or electrical devices. The signal source 5 is preferably designed in such a manner that a different current intensity is fed in at a respective outgoing branch 5*a*, 5*b*. This measure makes it possible to determine short circuits to other units if the sum signal of the currents, which would have to result from the individual currents fed into the branches 5*a* and 5*b*, cannot be determined in the detection device 6.

In order to obtain an even greater level of safety, it is conceivable for the two signal sources 5 in FIG. 2 to likewise feed different current intensities into the respective branches 5*a* and 5*b*. If short circuits then result, the type of error which does not make it possible to measure the current intensity to be measured per se can be determined in the detection device 6 by determining a current intensity. For example, one signal source supplies 2 mA to a branch 5*a* and 3 mA to the branch 5*b*. The other signal source 5 applies 0.8 mA to the branch 5*a* and 0.2 mA to the branch 5*b*. The sum signals 5 mA and 1 mA must thus be determined in the respective detection device 6 if the monitoring path is error-free. If, in contrast, 5.2 mA is measured instead of 5 mA in the associated detection device, there is, with a high degree of certainty, a short circuit to that branch of the safety circuit into which 0.2 mA are fed.

The relays, for example the relay 1, 51, switch with the make contacts 1*a* and 51*a*, respectively, and the safety contacts 1*b* and 51*b*, respectively, only when the correct current intensities are detected in the detection device 6. In the same manner, the relay 2, 52 then switches with the make contacts 2*a*, 52*a* and the safety contacts 2*b*, 52*b*. The load circuits 101, 101*a* are thus closed. The signal source can emit both a DC signal and an AC signal, for example an AC signal at 330 kilohertz. A refinement of the safety circuit such that two signal sources are available for a safety circuit 103, 104 is likewise conceivable, a check being carried out during each test with the two different test signals. Such a safety circuit then preferably also has two filters. It is thus possible to carry the test on two different signals at the same time if said signals are at a different frequency, for example. This procedure makes it possible to preclude the situation in which a test is positive if a load signal is very similar to the test signal. In order to check whether a switched signal can be interpreted as a test signal, a measurement without a test signal can additionally be carried out first of all. In addition, signals and/or filters of the different safety circuits may be different. As already described above, this makes it possible to determine short circuits.

The safety circuits may also be, for example, part of a bus on which digital signals run. A bandpass filter in the form of an RC network or a coil is possible, for example, as a filter. If it is ensured with certainty in a circuit that no interfering signal can be coupled into the circuit, for example, from the side 14 or 13 of the load circuit 101, 101*a*, 102, 102*a*, it is possible to dispense with corresponding protective elements 7, 8 or overvoltage components 9 on the side opposite the respective series circuit comprising relays.

FIG. 3 is a variant of four series circuits comprising relays 1, 2; 21, 22; 51, 52; 53, 54, in which a total of two safety circuits 103 and 104 suffice as a result of the safety contacts 1*b* and 2*b* of two respective series circuits being connected in series. This makes it possible to save on components for the safety circuit.

FIG. 4 shows the situation in which each series circuit comprising relay contacts 1*b*, 1*c*, 2*c*, 2*b*, 1*c*, 2*c*, 2*b* is monitored by a separate safety circuit 103. However, two groups of three relay contacts are respectively accommodated in one relay, for example the relay contacts 1*a*, 1*b*, 1*c* and 51*a*, 51*b*, 51*c*, respectively, in the relay 1, 51. The relay 1, 51 has a coil 31 and a driver 12.

As described in detail with respect to FIG. 2, different test signals can be fed in by the signal source 5 in all exemplary embodiments. Different filters 10 or a plurality of filters 10 may also be used. For example, a microcontroller is used for current evaluation.

The invention claimed is:

1. A safety switch device for switching a power supply for a load on and off, comprising:

two driveable switching elements connected in series;

a safety circuit for checking a switching state of the two driveable switching elements, each driveable switching element being in the form of a changeover switch having a first contact physically and electrically connected to one of a second contact and a third contact by way of a switching operation; and an electrical decoupler to decouple the safety circuit from the power supply for the load, wherein the power supply is completely isolated from the load when the two driveable switching elements are connected to the safety circuit.

2. The safety switch device as claimed in claim 1, wherein the second contact is electrically connected to the safety circuit and the third contact is electrically connected to the load.

3. The safety switch device as claimed in claim 1, wherein the switching element connects the first contact and the second contact for the safety circuit in a de-energized state.

4. The safety switch device as claimed in claim 1, wherein the safety circuit is formed when the first and second contacts are electrically connected and a load circuit is formed when the first and third contacts are connected.

5. The safety switch device as claimed in claim 1, wherein the safety circuit comprises a transmission part and an evaluation part, the transmission part being arranged on one contact side of the at least one switching element and the evaluation part being arranged on the other contact side of the at least one switching element.

6. The safety switch device as claimed in claim 1, wherein the safety circuit comprises overvoltage protection.

7. The safety switch device as claimed in claim 1, further comprising a control circuit to check whether two series-connected switching elements in a de-energized state are in a switching position in which the switching elements close the safety circuit.

8. The safety switch device as claimed in claim 1, comprising at least two series circuits comprising at least two driveable switching elements.

9. The safety switch device as claimed in claim 8, wherein a safety circuit is formed via each series circuit.

10. The safety switch device as claimed in claim 8, wherein a load circuit is formed via each series circuit.

11. The safety switch device as claimed in claim 1, wherein two series circuits each comprising at least two driveable switching elements form part of a single safety circuit.

12. The safety switch device as claimed in claim 1, wherein two parallel-connected series circuits comprising at least two driveable switching elements jointly use a detection device in order to form a safety circuit.

13. The safety switch device as claimed in claim 1, wherein each driveable switching element comprises an actuator.

14. The safety switch device as claimed in claim 1, comprising a first and a second series circuit comprising at least two driveable switching elements connected in parallel, and an actuator to actuate a respective driveable switching element in the first and second series circuits.

15. The safety switch device as claimed in claim 1, wherein the driveable switching element is a relay.

16. The safety switch device as claimed in claim 1, wherein the electrical decoupler comprises at least one of a capacitor and an optocoupler.

17. The safety switch device as claimed in claim 1, wherein the electrical decoupler comprises a capacitor and an optocoupler.

* * * * *